United States Patent [19]

Ferchau et al.

[11] Patent Number: 4,682,833

[45] Date of Patent: Jul. 28, 1987

[54] ALIGNMENT AND CONNECTION MECHANISM

[75] Inventors: Joerg U. Ferchau, Morgan Hill; Victor D. Trujillo, Fremont, both of Calif.

[73] Assignee: Tandem Computers Incorporated, Cupertino, Calif.

[21] Appl. No.: 898,878

[22] Filed: Aug. 21, 1986

Related U.S. Application Data

[63] Continuation of Ser. No. 702,109, Feb. 15, 1985, abandoned.

[51] Int. Cl.[4] ..... H01R 13/64

[52] U.S. Cl. ..... 439/377; 439/259

[58] Field of Search ..... 339/65, 66 R, 66 M, 339/75 M, 64 R, 64 M, 75 R

[56] References Cited

U.S. PATENT DOCUMENTS

| | | | |
|---|---|---|---|
| 3,116,959 | 1/1964 | Abodeely | 339/66 M |
| 3,129,044 | 4/1964 | Lyman, Jr. et al. | 339/66 M |
| 3,264,601 | 8/1966 | Hartholz | 339/65 |
| 3,571,780 | 3/1971 | Boenning et al. | 339/66 M |
| 3,951,500 | 4/1976 | Anderson | 339/65 |
| 4,361,372 | 11/1982 | Majkrzak et al. | 339/64 M |
| 4,509,258 | 4/1985 | Locati et al. | 339/65 |

*Primary Examiner*—Gil Weidenfeld
*Assistant Examiner*—Gary F. Paumen
*Attorney, Agent, or Firm*—Townsend and Townsend

[57] ABSTRACT

A storage unit for an array of modular assemblies, such as disk drives, includes a cabinet having an array of rectangular cavities open toward the front, each for receiving an assembly carrier drawer. Each carrier drawer has electrical connections for receiving an electrical assembly in the drawer. The rear of each drawer has an electrical connection panel for mating a receiving panel connected to the inside back of the cabinet, and associated with the electrical connection panels are pin-and-aperture locating and registering means for precisely aligning the carrier drawer for proper mating electrical contact with the back of the cabinet automatically as the carrier drawer is pushed fully into the cabinet. This enables disk drive maintenance to be performed quickly and efficiently by pulling out a carrier drawer and inspecting, repairing or replacing the modular assembly.

4 Claims, 7 Drawing Figures

ALIGNMENT AND CONNECTION MECHANISM

This is a continuation of application Ser. No. 06/702, 109, filed Feb. 15, 1985, now abandoned.

BACKGROUND OF THE INVENTION

The invention relates to alignment and connection systems and mechanisms. More particularly, the present invention relates to an alignment system and mechanism that provides modular circuitry and/or system assemblies for self-aligning inclusion and automatic connection within a host cabinet.

There is a recognized need for modularization of e.g. complex electronic systems and subsystems. This need is primarily associated with maintenance operations where it is desirable to remove a universal module and replace it with a like one known to be operational, and then repair the module at a centralized maintenance facility. In some situations, the number of connections to and from the module is large, and may include power supply, data signals, control signals and control panel signals. Heretofore, modular assemblies have typically required manual connection of plugs having sufficient contacts to accomodate the myriad signal and supply paths required.

In the specific environment of reliable, non-stop data processing, the need for high-volume data storage is rapidly growing in many businesses, with increasingly more information to be accessed. At the same time the prime cost of small (e.g. eight inch) high capacity fixed disk drive units is significantly decreasing. Consequently, many computer systems increasingly utilize arrays of daisy-chained small fixed disk drives. Down time and the ability to maintain these disk drives efficiently has been a problem. When data is being processed on-line, significant delays or interruptions often cannot be tolerated. Information must be avialable when needed, and maintenance of disk drive units, when necessary, must be capable of being accomplished quickly and efficiently.

SUMMARY OF THE INVENTION

A general object of the present invention is to improve over prior art connection methods and devices for modular assemblies.

One specific object is to improve disk drive storage facilities previously available by providing a storage system for an array of disk drives, wherein each disk drive is carried in a universal module which is automatically connected when installed and which is readily accessible for inspection or very fast replacement when needed.

In accordance with the present invention, a housing and a carrier drawer are each provided with electrical connection means and connector locating and registering means that automatically aligns and positions the carrier drawer as it is pushed fully into the housing so that blind-matable electrical connection is established between a plurality of connector leads the drawer and housing as the carrier drawer reaches its inserted position within the housing.

In this manner, assembly maintenance can be performed by pulling a carrier drawer out and inspecting, repairing or replacing parts or all of the assembly.

More specifically, the preferred embodiment of the invention includes mounting the matable parts of the electrical connection means to a surface of an apertured printed circuit board or panel with the matable parts (typically of the type including an array of electrical contacts—such as engageable male—female connections) being located with relative precision to at least two of the apertures. A pin-cylinder pair locator system is installed: One part of the system (i.e., the cylinder) is mounted on the carrier drawer, the other part on the cabinet in the cavity that receives the drawer. The parts include extended portions adapted to be received by respective ones of the apertures when the circuit boards (carrying the connector means) are mounted to the carrier drawer and the cabinet. One circuit board, and associated part of the pin-cylinder locator system, is mounted on a rear portion of the carrier drawer (i.e., that part of the drawer that is brought into confronting relation with a rear portion of the cavity when the drawer is inserted therein), and another on the rear portion of the cavity.

When the carrier drawer is inserted into the cavity and moved toward the cavity's rear portion, guide rails establish an initial alignment sufficient for locating the pin relative to the cylinder for insertion. When the carrier drawer is inserted far enough in the cavity, one pin-cylinder combination establishes a point registration between the two circuit boards and their respective connectors. At the same time, a second pin associated with one circuit board is located to enter an aperture of the other circuit board. Together, the system accurately registers the circuit boards to one another, providing or establishing blind-matable, self-alignment engagement of the connector means carried by the circuit boards.

Accordingly, it is among the objects of the invention to provide slideable drawer-type carriers for assemblies with the assembly being easily inserted into the drawer carrier for electrical connection therein and with each drawer having a mechanism for assuring proper alignment and corresponding mating connection between two electrical contact panels, all in one linear motion of insertion of the drawer into the cabinet. These and other objects, advantages, features and characteristics of the invention will be apparent from the following description of the preferred embodiement, considered along with the accompanying drawings.

DESCRIPTION OF A PREFERRED EMBODIMENT

Figure 1:
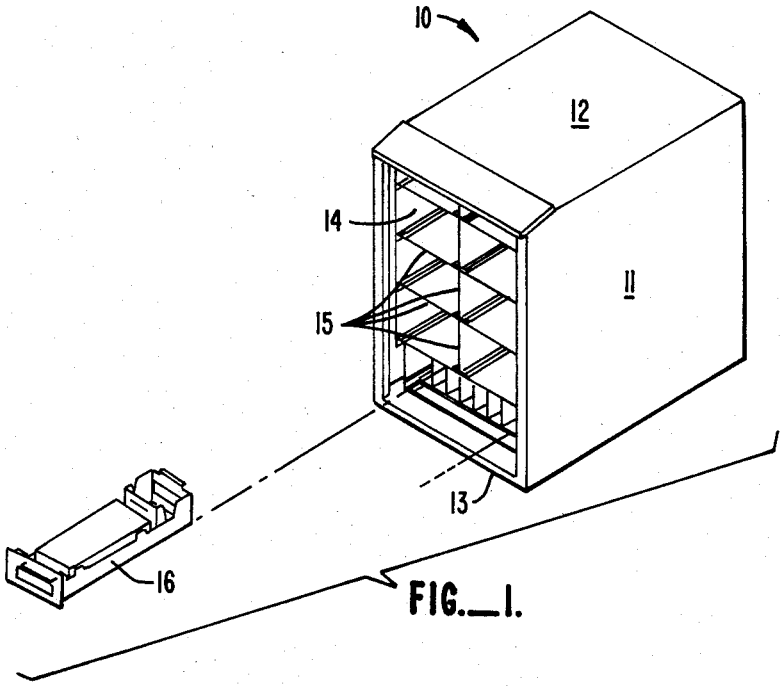
FIG. 1 is a perspective view of a storage cabinet forming a part of a disk drive storage assembly embodiment of the invention, with the front of the cabinet and a carrier drawer visible.
Figure 2:
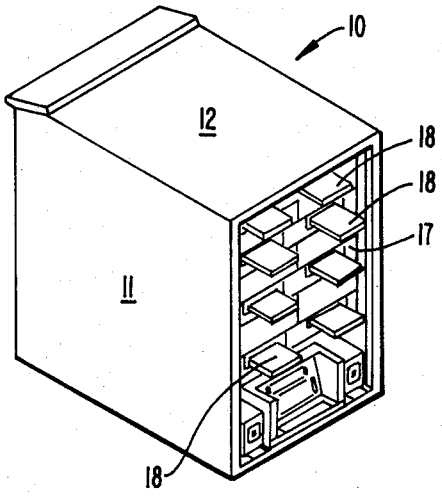
FIG. 2 is another perspective view of the cabinet of FIG. 1, showing the rear of the cabinet.

In the drawings, FIGS. 1 and 2 show a storage cabinet 10 for a disk drive storage system, for example, according to the invention. The storage cabinet 10 includes side walls 11, a top 12 and a bottom 13, and interior partitions 15 form an array of cavities 14 for receiving a plurality of carrier drawers 16. At the rear of the cabinet 10 is a back wall portion 17, to which a plurality of connector planes 18 are secured, each plane 18 carrying a connecting circuit board 23, to which is mounted a connection plug 24 to establish electrical connection with a disk drive unit (held by the carrier drawer 16) and external disk drive controller equipment (not shown) when the storage cabinet 10 is filled and in operation.

Figure 3:
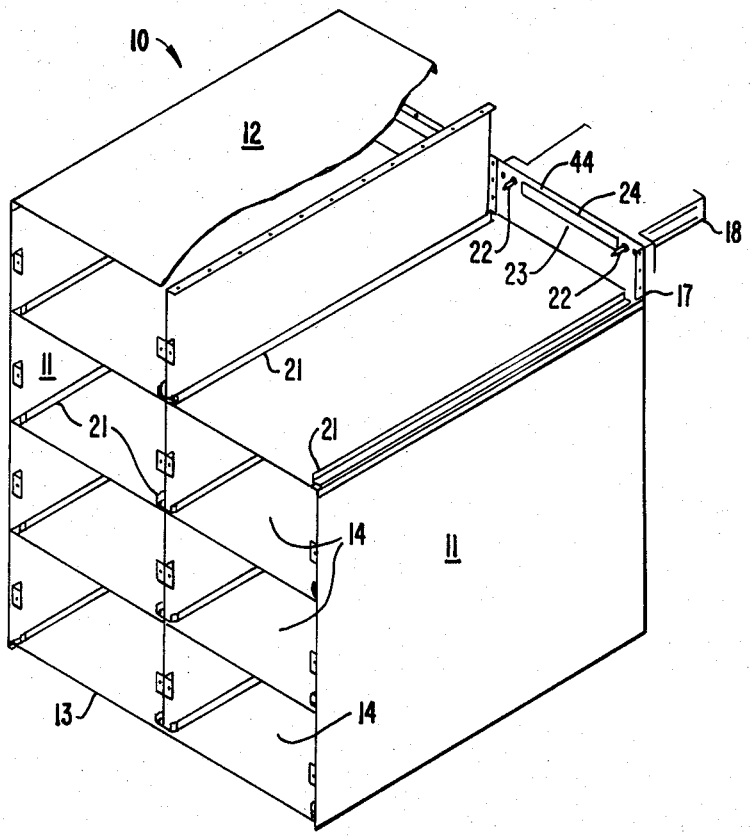
FIG. 3 is a partially broken away perspective view of the storage cabinet of FIG. 1, showing the top, front and side of the cabinet and indicating some of the details of construction of the cabinet.

As indicated in the construction view of FIG. 3, the cabinet 10 may be made up of flat sheet material, e.g., metal or rigid plastic, suitably welded together to form the plurality of drawer-receiving cavities 14. Within each cavity 14 is preferably included a pair of guide rails 21, each comprising a generally L-shaped (in cross section) rail connected into the cavity as indicated, for providing a restricted and relatively closely defined path that guides the sliding motion of a carrier drawer 16 onto the cavity.

FIG. 3 also illustrates a connector plane 18 at the rear of the storage cabinet 10. A pair of tapered alignment pins 22 are mounted to the back wall 17 and extend through the back wall portion 17 of the storage cabinet 10. The alignment pins 22 enable proper location the circuit board 23 and, in particular, the connector plug 24 mounted thereto. Connector plug 24 is of the type having as many as 240 separate electrical miniature connector pins (for example arranged a four horizontal rows of sixty pins each). The connector pins of the connector plug 24 protrude through or are exposed through an opening 44 formed in the back wall portion 17.

Figure 5:
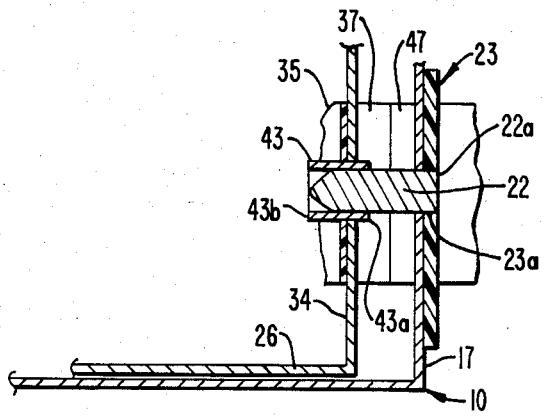
FIG. 5 is a sectional side elevation view showing portions of the cabinet of FIG. 1 and of a carrier drawer in connected engagement and indicating the details of the electrical connection and alignment components.

As illustrated in FIG. 3, and in greater detail in FIG. 5, the circuit board 23 is appropriately apertured with mounting holes 23A to receive rear extensions 22A of the alignment pins 22 that protrude rearwardly from the back wall portion 17. In practice, the connector plug 24 is accurately mounted to the circuit board 23 relative to the pin-receiving mounting holes 23A. The circuit board 23 and mounted connector plug 24 is then, in turn, mounted to the back wall portion 17 of the storage cabinet 10 with the rear extensions 22A inserted in the mounting holes 23A, thereby accurately positioning the connector plug 24 relative to the alignment pins 22 and to the particular cavity 14 of storage cabinet 10 with which the alignment pins 22 are associated. As will be seen below, matable parts of the carrier drawer 16 are arranged in similar fashion for blind-matable engagement between the connector plug 24 and its corresponding mating part carried by the drawer 16.

Figure 4:
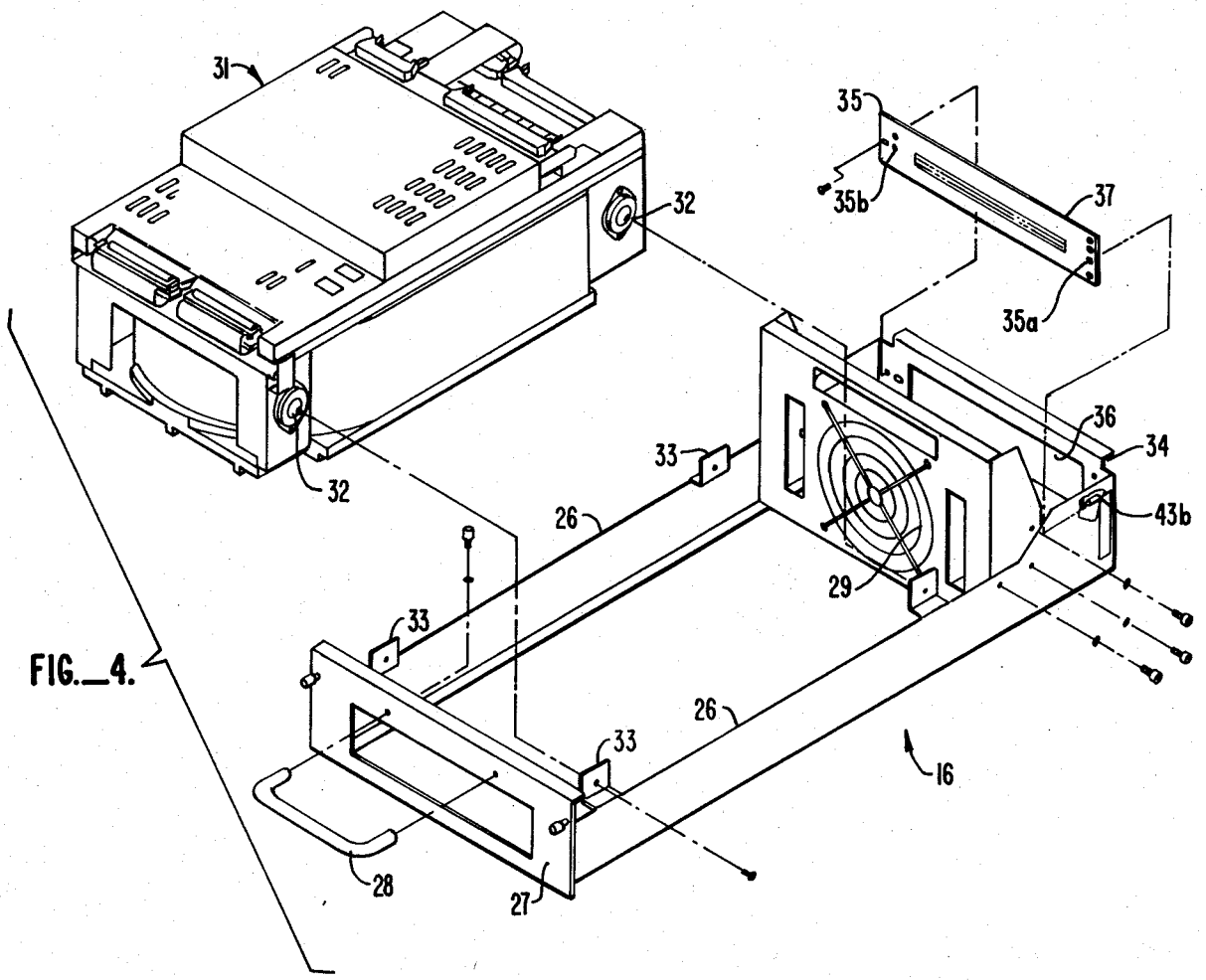
FIG. 4 is an exploded view in perspective showing a disk drive unit as it is received in a carrier drawer of the type depicted in FIG. 1. Apparatus is included which achieves both proper alignment and proper electrical connection between the carrier and the back of a cavity of the storage cabinet in one linear motion.

In FIG. 4 a carrier drawer 16 of the system is shown in greater detail. The carrier drawer 16 comprises a generally rectangular frame 26 which may have at its front 27 a typical drawer pull 28. A cooling fan 29 preferably is included in the carrier drawer 16 to dissipate heat from the heat generating elements of a modular disk drive unit 31 to which the drawer 16 is adapted.

The modular disk drive unit 31 fits closely within the carrier drawer 16 as indicated in FIG. 4, with shock mounts 32 on each side of the disk drive being positioned to abut flanges 33 of the drawer as shown. The disk drive is electrically connected within the drawer 16 by a data cable or ribbon cable (not shown) leading from plug-in power, data and control signal connections with the disk drive to jack contacts of a connector plug 37 (which are numbered and aligned to mate with corresponding connector pins of the connector plug 24 mounted to the back wall portion 17 of the cabinet). The connector plug 37 is mounted to a circuit board 35.

At the rear portion 34 of the carrier drawer 16 is formed an elongated opening rear portion 36, for receiving the electrical connector plug 37 as indicated, so as to expose a array of jack or contact openings rearwardly through the opening 36. The connector plug 37 is bolted, screwed or otherwise appropriately fastened to the drawer back 34, further details of this arrangement being shown in FIGS. 5 and 6.

FIGS. 5 and 6 shown an important perferred feature of the invention whereby a single set of components both properly locate electrical connector panels on the respective structures to which they are affixed and also locate or register the two panels and the sets of electrical contacts in precise registry together as the carrier drawer 16 is pushed fully into place in a cavity 14 of the storage cabinet 10.

As FIG. 5 illustrates, the tapered alignment pins 22 extend inwardly of the cabinet 10 from the back wall portion 17. Each alignment pin 22 is affixed to the back wall portion 17 and projects horizontally toward the front opening of each cavity.

When the carrier drawer 16 is slid into the cavity 14, the tapered alignment pins 22 first encounter then enters and fits closely into an appropriately sized and aligned apertures 39 formed in the back 34 of the drawer. At least one of the apertures 39 preferably is precisely bored, so that the connector 37 thereby becomes precisely located with and then connected to the complementary connector 44 of the cabinet 10 as the drawer 16 becomes fully inserted into the cavity 14.

Figure 6B:
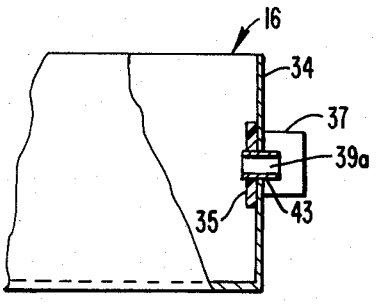
FIG. 6B is a side elevation view of the carrier drawer of FIG. 1, shown partly in section.
Figure 6A:
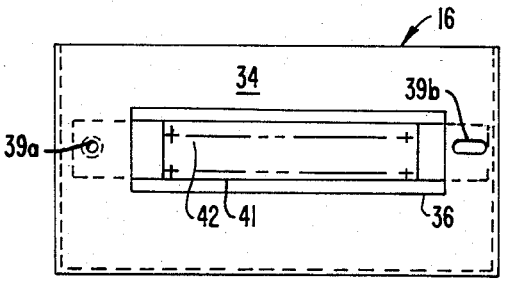
FIG. 6A is an elevation view looking at the rear of a carrier drawer of the type depicted in FIG. 1.

FIG. 6A shows the carrier drawer 16 from the rear, and illustrates a peripheral protrusion 41 of the connector plug 37 as extending through the drawer back opening 36 to expose and protect the plurality of electrical leads or contacts 42 at the rear of the drawer 16. FIG. 6B shows the alignment aperture as being formed by a precise machined cylinder 43 defining a precise horizontal aperture 39*a* (on the left in FIG. 6A) and an oval or slotted-hole type aperture 39*b* formed in the back panel 34 of the drawer on the other side (on the right in FIG. 6A). With this arrangement, one tapered pin 22 entering the machined aperture 39*a* aligns the drawer both horizontally and vertically, while the other tapered pin 22 entering the oval aperture 39*b* merely aligns the drawer vertically, and permits some relative tolerance in the horizontal dimension, to facilitate the self aligning plug-in electrical connection.

As FIGS. 5 and 6B illustrate, the machined cylinder 43 is provided a length that extends through the backed panel 34 of the carrier drawer 16, forming outer and inner portions 43*a* and 43*b*, respectively. An aperture 35*a* is formed near one end of the circuit board 35 that is sized to snugly receive the inner portion 43*b* of the machined cylinder 43, accurately positioning the circuit board 35, and the connection 37 mounted thereon, relative to the carrier drawer 16—in the same manner circuit board 23 is accurately positioned relative to the tapered connector pin 22 by the aperture 23*a* and 22*a* combination. Near the opposite end of the circuit board 35 is a second aperture 35*b*, located to be exposed to penetration by an alignment pin 22 through the elongated or slotted aperture 39*b*.

The electrical connector 34 which is connected to the connector plane 18 at the rear of the storage cabinet 10 (see e.g., FIG. 2) includes a peripheral protrusion 47 surrounding the contact pins of the connector plug 24 and projecting forwardly from the back wall portion 17 of the storage cabinet 10. The protrusion 47 is complementary with and mates with the protrusion 41 of the connector plug 37 of the drawer 16.

When the carrier drawer 16 carrying the disk drive 31 is pushed into the cavity 14 provided in the storage cabinet 10, the guide rails 21 provided in each drawer-receiving cavity 14 (see FIG. 3) establish a preliminary, approximate alignment of the carrier drawer 16 within the cavity 14, at least sufficient to assure that the alignment pins 22 with their tapered ends enter the appropriate apertures 39.

The one cylindrical aperture 39*a* is sized to closely fit over the corresponding alignment pin 22 for precise alignment, both side-to-side and up-and-down. The other aperture 39*b*, described above as elongated or slotted, an aperture 35*b* formed in the circuit board 35, receives the other corresponding alignment pin 22 thereby assuring proper vertical location of the drawer 16 and providing some degree of relative horizontal freedom so that the electrical contacts of the connector plugs 37 and 44 mate freely. In the presently preferred embodiment, all power supply lines, control signals and data signals are connected through the connector plugs 37 and 44, so that the disk drive unit (and cooling fan) become electrically powered and functional automatically and merely by virtue of placement of the drawer 16 in its respective cavity 14 in the storage cabinet 10. Multiple pins and jacks of the connector plugs 37, 44 may be parallel connected to provide sufficient current handling capability to provide the necessary power supply connection to the apparatus contained in the drawer.

To those skilled in the art to which the present invention pertains many changes in construction and widely varying embodiments will be suggested without departure from the spirit and scope of the present invention. The description and the disclosures herein are presented by way of illustration of this invention and are not limiting of the scope thereof.

We claim:

1. In an assembly, including a cabinet formed to have at least one drawer-receiving cavity, a drawer configured for removable insertion in the cavity, and at least a pair of connector parts respectively associated with the cabinet and the drawer, an alignment system to provide blind-matable connection of the connector parts to establish electrical connection therebetween when the drawer is inserted in the cavity, the alignment system comprising:

a pair of mounting means, for respectively mounting each of the connector parts to the cabinet and the drawer at locations that place the connector parts in interconnecting engagement when the drawer is inserted in the cavity, each mounting means having formed therein at least a pair of apertures, each connector part being mounted on the mounting means and accurately positioned with respect to the apertures formed in the respective mounting means;

alignment means respectively formed on the cabinet and the drawer, and being engageable with each other to align a portion of the cabinet to a portion of the drawer, the alignment means having extensions which are received by the apertures when the pair of mounting means are in place, thereby accurately positioning the connector parts with respect to their corresponding alignment means and with each other.

2. The alignment system of claim 1, wherein the alignment means includes a plurality of elongate pin structures mounted to the cabinet to extend into the cavity.

3. The alignment system of claim 2, wherein the elongate pins each include means forming the extensions for receipt by the apertures formed in the associated mounting means.

4. The alignment system of claim 3, wherein the alignment means includes apparatus forming a bore on the drawer for receiving at least one of the elongate pins when the drawer is inserted in the cavity.

* * * * *